US005913784A

United States Patent [19]

Hite

[11] Patent Number: 5,913,784

[45] Date of Patent: Jun. 22, 1999

[54] DECKING SYSTEM

[76] Inventor: John D. Hite, 911 Dale Ave., Bradfordwoods, Pa. 15015

[21] Appl. No.: 08/929,115

[22] Filed: Sep. 15, 1997

[51] Int. Cl.[6] ..... E04F 11/16

[52] U.S. Cl. ..... 52/177; 52/179; 52/650.3

[58] Field of Search ..... 52/177, 403.1, 52/480, 650.3, 179, 181, 737.3, 737.6, 737.5

[56] References Cited

U.S. PATENT DOCUMENTS

| | | | |
|---|---|---|---|
| 4,885,882 | 12/1989 | Forshee | 52/177 |
| 4,907,387 | 3/1990 | Turnbull . | |
| 5,009,045 | 4/1991 | Yoder . | |
| 5,048,448 | 9/1991 | Yoder | 114/263 |
| 5,070,664 | 12/1991 | Groh et al. . | |
| 5,613,339 | 3/1997 | Pollock | 52/177 X |
| 5,617,689 | 4/1997 | Beane | 52/177 X |
| 5,642,592 | 7/1997 | Andres | 52/177 |

*Primary Examiner*—Christopher Kent
*Assistant Examiner*—Yvonne Horton-Richardson
*Attorney, Agent, or Firm*—Wm. Randall May

[57] ABSTRACT

A decking system utilizing non-skid plastic covers applied to specially sawn wooden deck members is disclosed. The wooden deck members include a plurality of channels or "kerfs" which are sawn or notched into one side of each deck member. The covers have leg members which are specifically designed to match or mate with the kerfs of the deck members. The kerfs of the deck members and the leg members of the plastic covers have dimensions which allow for the expansion and contraction of the deck members, as well as the cross-sectional expansion and contraction of the covers, during periods of extreme atmospheric conditions.

17 Claims, 2 Drawing Sheets

ILLUSTRATION OF COMBINED EFFECTS OF RADIAL AND TANGENTIAL SHRINKAGE SHOWING DISTORTION OF SHAPE OF VARIOUS WOOD PIECES DUE TO DIFFERENCE IN SHRINKAGE AND CURVATURE OF ANNUAL RINGS.

DECKING SYSTEM

BACKGROUND OF THE INVENTION

This invention relates generally to decking materials and more specifically to a uniquely designed deck system which incorporates specially sawn wooden deck planks which are mated with companion, non-skid, plastic covers.

Wooden decks are utilized extensively in the construction industry from residential patio decks to commercial decking for restaurants, apartments, retail stores, marinas and other commercial establishments. Wooden decking is also used for many other commercial and industrial applications such as platforms, walkways, docks and piers. Moreover, structural wood framing and decking are a cost effective means for expanding usable space while seasonably providing an outdoor atmosphere for patrons, workers, guests and residents.

However, wood decking with all its advantages, when used in applications which are exposed to outdoor atmospheric conditions will, over time, tend to splinter, check, warp and rot as a result of the absorption of moisture and the effects of alternating wetting and drying, freezing and thawing and the associated swelling and shrinking attributable to such exposures.

It is known that wood will shrink and swell very slightly along its length, but will shrink and swell significantly in the direction of its annual growth rings (tangentially) and about one-half as much "across" the rings (radially) (see FIGS. 4 & 5). These dimensional fluctuations should be taken into consideration and accommodations made for same when designing a decking system utilizing wooden planks.

Attempts have been made to overcome some of the problems associated with wood decking by the use of plastic, steel and aluminum deck members. However, all of these materials have cost disadvantages relative to wood decking and have other disadvantages such as high corrosion, heat absorption and transfer problems, high coefficient of expansion and low coefficient of friction.

It would be expedient, therefore, to provide a decking system which utilizes the structural cost advantage of wood decking and, as a result of well developed techniques, the ease of installation of wood decking, while at the same time accommodating the physical characteristics of wood and eliminating other problems and disadvantages associated with wood.

SUMMARY OF THE INVENTION

In view of the foregoing, it is a primary object of this invention to provide a decking system and method which incorporates all the advantages of wood decking while virtually eliminating the disadvantages of long term use of such material. According to an embodiment of the invention, a wood deck-cap system utilizes specially sawn wooden planks which have been pressure treated with a wood preservative for protection against decay associated with exposure to moisture and heat. The planks are capped on one side with an embossed plastic cover which provides for a non-skid surface. The covers are specifically designed to mate with and attach to said specially sawn planks and have been extruded with dimensions which allow for the expansion and contraction of the planks as well as the cross-sectional expansion and contraction of the covers themselves. The covers are adhered to the planks in a manner which restrains the cumulative longitudinal expansion and contraction of the covers when exposed to ambient atmospheric conditions.

More specifically, a preferred embodiment of the invention comprises wooden planks having a plurality of grooves or kerfs sawn longitudinally into one side of each plank. Attached to each plank is an embossed plastic or vinyl top having spaced ribs specifically designed to match, and mate with, the kerfs sawn into the deck planks.

An advantage of the present invention is the provision of a deck system which utilizes a durable non-skid plastic deck cover applied to wooden deck planks, said covers being designed to accommodate and allow for the dimensional fluctuations inherent to such planks.

Another advantage of the present invention is the provision of a decking system which is safe and cost effective yet superior to conventional decking systems in its construction, durability and versatility.

A further advantage of the present invention is the ability to design and build decks of virtually unlimited colors without the use of high maintenance finishes such as paint or stain.

Another advantage of the present invention is the provision of a wooden deck-cap system having components with cross-sectional dimensions which allow for the natural expansion and contraction of the components without shape distortion.

A further advantage of the invention is the superior deterioration protection and decay resistance afforded by the invention through the combination of its pressure treated wooden planks and plastic deck caps.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
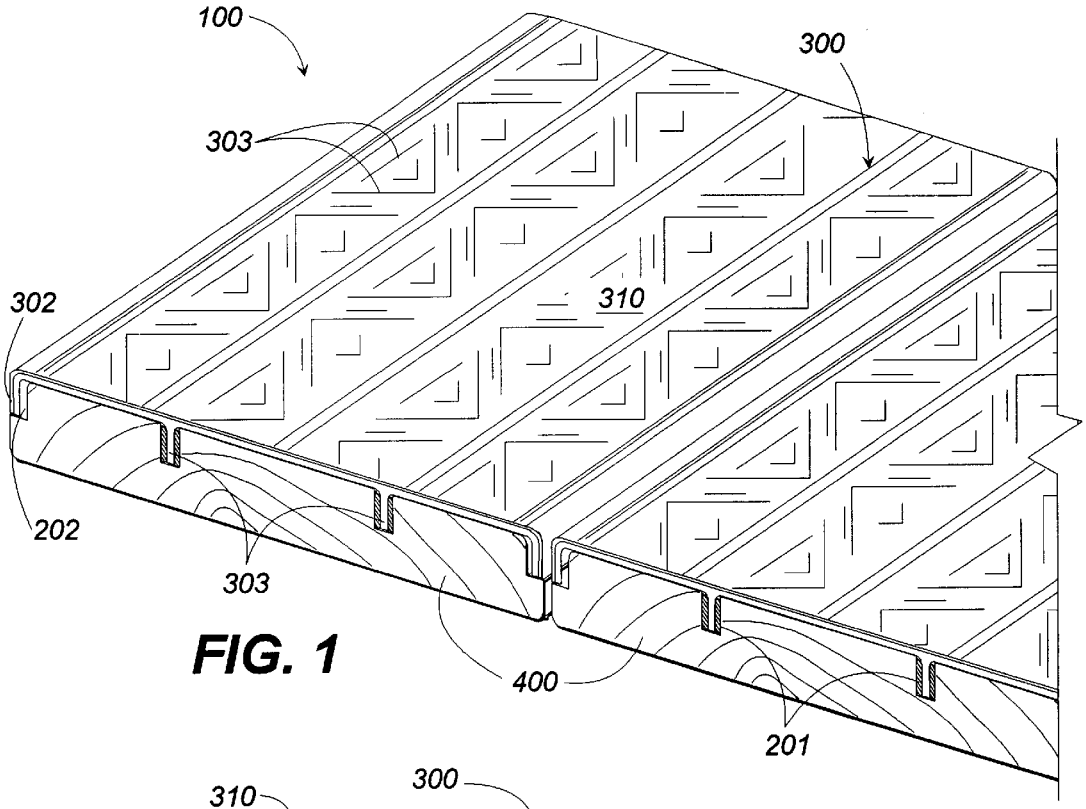
FIG. 1 is a perspective view of an embodiment of the decking system of the present invention shown in an installed configuration.
Figure 2:
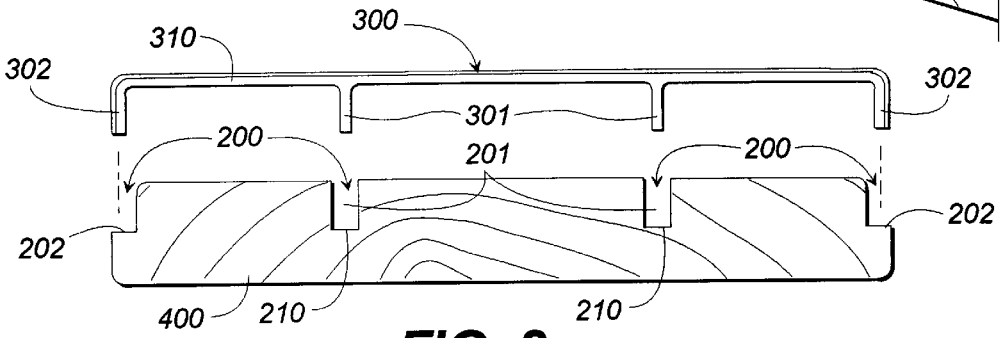
FIG. 2 is an exploded, cross-sectional view of the components of the embodiment of FIG. 1.
Figure 3:
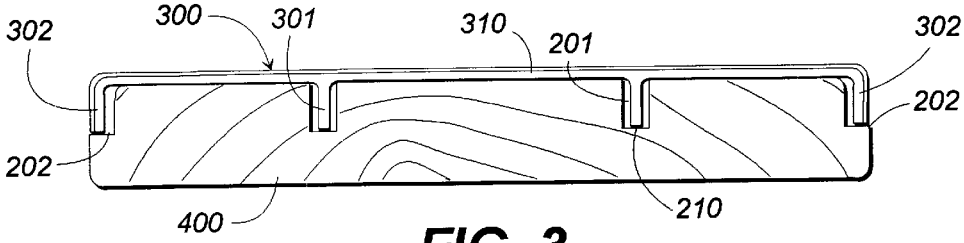
FIG. 3 is a cross-sectional view of the invention showing the components of the invention in an installed configuration.
Figure 4:
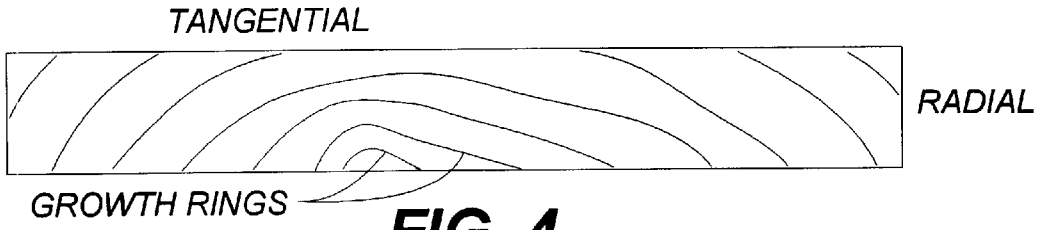
FIG. 4 is a cross-sectional view of a typical deck plank showing the growth rings of the plank and identifying the tangential and radial dimensions of the plank.
Figure 5:
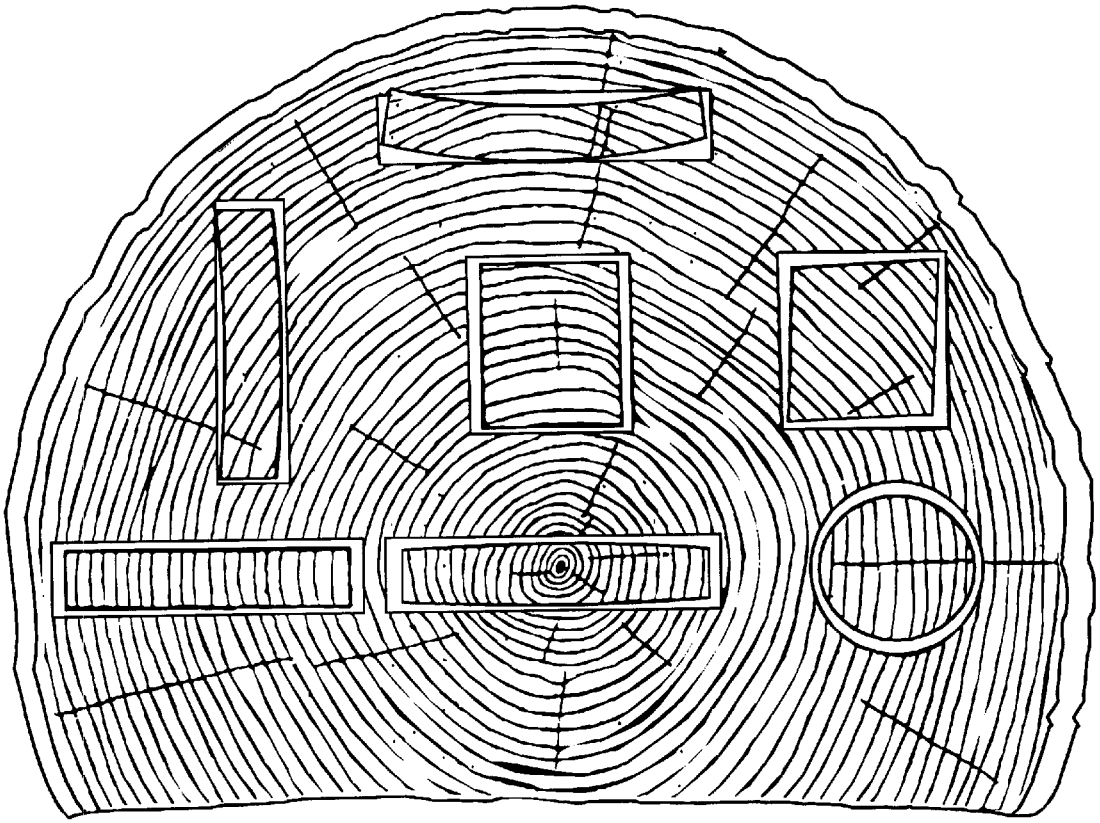
FIG. 5 is a cross-sectional view of a typical unmilled log showing the characteristic shrinkage and distortion of various cuts of lumber as affected by the direction of the annual growth rings.

In accordance with an embodiment of the invention, FIG. 1 shows a decking system 100. The system 100 of FIG. 1 comprises a plurality of specially sawn wooden deck base members 400 with each member 400 having a cap means 300 attached to, and covering one face side of, said wooden member 400. Said cap means 300 extends substantially the length and width of said member 400 and comprises a sheath means 310 having a plurality of ribs or leg members 301,302 which are spacably positioned on the underside of said sheath means 310. The deck base members 400 are provided with a plurality of kerf means 200 sawn into the face side of each member 400 for receiving the leg members 301,302 of said sheath means 310.

In the present embodiment, said sheath means 310 is constructed of pliable vinyl or plastic and, as best shown in the embodiment of FIG. 1, covers the width and length of the face side of each deck member 400. The outer surface of each sheath 310 is embossed so as to form a skid-resistant surface 303. Each sheath 310 is provided with a pair of internal or "adhesion" legs 301 and a pair of outer or "expansion" legs 302 for insertion into the matching kerfs 200 of the host deck member 400. Said leg members 301,302 run the length of said sheath 310 and have dimensions which allow the leg members 301,302 to be easily inserted into the matching kerfs 200 of the host member 400. The dimensions and positioning of the sheath legs 301,302 within said kerf means 200 allow for expansion and contraction of the host deck member 400 during periods of extreme atmospheric conditions.

The kerf means 200 of each deck base member 400 comprise one or more parallel "adhesion" kerfs 201 and a pair of "expansion" kerfs 202. The adhesion kerfs 201 are sawn into each member 400 and form channels 210 which run parallel to the length of the member 400 and are of sufficient width and depth to receive the internal legs 301 of the sheath means 310. The expansion kerfs 202 sawn are along the outer longitudinal edges of the deck face side of said member 400 and extend the length thereof. The expansion kerfs 202 are of sufficient width and depth to receive the expansion legs 302 of the sheath means 310 and to also provide additional space to allow the deck member 400 to expand radially and tangentially to its potential without distorting the shape of the cap means 300. The kerf means 200 and leg members 301,302 of the present embodiment are shown having matching linear dimensions with respect to said deck members 400 and with respect to each other, however, matching non-linear, angular or curvilinear dimensions are anticipated by the present invention as alternate embodiments.

During typical assembly, the deck base members 400 are fastened to conventional structural wood framing using well established techniques and conventional fasteners. The channels 210 of the adhesion kerfs 201 of said members 400 are then filled with a commercial grade adhesive. Deck sheaths 310 of specified color, duty and dimensions are then positioned onto the deck base members 400 with the adhesion legs 301 and the expansion legs 302 of said sheath 310 being positioned into their respective matching kerfs 201, 202.

While the invention has been particularly shown and described with reference to the preferred embodiments thereof, it will be understood by those skilled in the art that various alterations in form and detail may be made therein without departing from the spirit and scope on the invention.

The embodiments of the invention in which an exclusive property right or privilege is claimed are defined as follows:

1. A decking system comprising:

a plurality of specially sawn, pressure treated, wooden deck members spaceably attached to conventional framing so as to form a floor or platform with each deck member having a face or flooring side with outer longitudinal edges and one or more "adhesion" channels or "kerfs" positioned longitudinally on the face or flooring side of said member and having a pair of "expansion" channels or "kerfs" positioned along the outer longitudinal edges of said face side of said deck member, said adhesion kerf(s) being spaceably positioned between said pair of expansion kerfs and being filled with an adhesive or bonding agent; said adhesion kerf(s) and said expansion kerfs being designed to receive, and mate with, a cap means, having a skid-resistant surface, attached to the face side of each deck member at said adhesion kerf(s), said cap means comprising:

an elongated sheath with linear dimensions substantially equal to the face side dimensions of said deck member and having one or more "adhesion" leg members and a pair of "expansion" leg members spaceably positioned on the underside of said sheath so that said leg members are dimensionally compatible with, are received by, and mate with, the respective adhesion and expansion kerfs of said wooden deck member, said adhesion leg members being rigidly attached to said deck member at and along said adhesion kerf(s) only.

2. The apparatus of claim 1, wherein said cap means is embossed so as to create a non-skid surface.

3. The apparatus of claim 1, wherein said cap means is constructed of plastic material.

4. The apparatus of claim 1, wherein said adhesion kerf(s) comprise parallel, linear channels extending substantially the length of said deck member.

5. The apparatus of claim 1, wherein said adhesion kerf(s) are angular with respect to said expansion kerfs.

6. The apparatus of claim 1, wherein said adhesion kerf(s) are non-linear.

7. The apparatus of claim 1, wherein said adhesion kerf(s) are curvilinear.

8. The apparatus of claim 1, wherein one or more of said adhesion leg members are angular with respect to said expansion leg members.

9. The apparatus of claim 1, wherein one or more of said adhesion leg members are non-linear.

10. The apparatus of claim 1, wherein one or more of said adhesion leg members are curvilinear.

11. A decking system produced by a process comprising the steps of:

creating, as by sawing or notching, a pair of "expansion" channels or "kerfs" along the outer longitudinal edges of a face or flooring side of a plurality of pressure treated, wooden deck members;

creating, as by sawing or notching, one or more "adhesion" channels or "kerfs" so that said adhesion kerf(s) are positioned longitudinally on the face or flooring side of said plurality of pressure treated, wooden deck members, said adhesion kerf(s) being spaceably positioned between said pair of expansion kerfs;

filling said adhesion kerf(s) with an adhesive or bonding agent;

attaching to each deck member an elongated sheath having linear dimensions substantially equal to those of the face side of said deck member and having one or more "adhesion" leg members spaceably positioned between a pair of "expansion" leg members on the underside of said sheath so that said leg members are dimensionally compatible with, are received by, and mate with, the respective adhesion and expansion kerfs of said wooden deck member; and, assembling said deck members onto framing so as to form a floor or platform.

12. The product of claim 11, wherein the process of producing said decking system further comprises creating said adhesion and expansion kerfs as linear channels extending in parallel along the length of each deck member.

13. The product of claim 11, wherein the process of producing said decking system further comprises the creation of one or more of said adhesion kerfs as non-linear channels.

14. The product of claim 11, wherein the process of producing said decking system further comprises the creation of one or more of said adhesion kerfs as curvilinear channels.

15. The product of claim 11, wherein the adhesion and expansion leg members of said sheath are linear and extend in parallel along the length of each deck member.

16. The product of claim 11, wherein the adhesion leg members of said sheath are non-linear.

17. The product of claim 11, wherein the adhesion leg members of said sheath are curvilinear.

* * * * *